US005961311A

United States Patent [19]

Moore, Jr.

[11] Patent Number: 5,961,311

[45] Date of Patent: Oct. 5, 1999

[54] BURNER RE-IGNITION SYSTEM HAVING A PLURALITY OF FLAME SENSORS

[75] Inventor: Roger R. Moore, Jr., St. Paris, Ohio

[73] Assignee: Whirlpool Corporation, Benton Harbor, Mich.

[21] Appl. No.: 08/977,379

[22] Filed: Nov. 24, 1997

[51] Int. Cl.[6] ..... F23N 5/20; F24C 3/08

[52] U.S. Cl. ..... 431/6; 431/69; 431/266; 126/39 R; 126/39 E

[58] Field of Search ..... 431/69, 202, 25.6, 431/77.78, 258, 264, 266; 126/39 R, 39 BA, 39 H, 39 K, 39 E

[56] References Cited

U.S. PATENT DOCUMENTS

| | | | |
|---|---|---|---|
| 1,473,716 | 11/1923 | Wilcox | 431/202 |
| 1,650,343 | 11/1927 | Good | 431/263 |
| 2,682,017 | 6/1954 | Haworth | 431/266 |
| 3,614,280 | 10/1971 | Yamaguchi | 431/25 |
| 4,147,498 | 4/1979 | Clarke | 431/264 |
| 4,304,545 | 12/1981 | Matthews | 431/25 |
| 4,386,385 | 5/1983 | Hamilton | 361/253 |
| 4,405,299 | 9/1983 | Serber | 431/78 |
| 4,622,005 | 11/1986 | Kuroda | 431/78 |
| 4,626,196 | 12/1986 | Stohrer, Jr. | 431/264 |
| 5,149,262 | 9/1992 | Riehl | 431/258 |
| 5,160,256 | 11/1992 | Riehl | 431/266 |
| 5,195,885 | 3/1993 | Medina | 431/25 |
| 5,328,357 | 7/1994 | Riehl | 431/266 |
| 5,464,004 | 11/1995 | Maughan | 126/39 |
| 5,492,469 | 2/1996 | Oda et al. | 431/266 |

*Primary Examiner*—James C. Yeung

*Attorney, Agent, or Firm*—Robert O. Rice; Joel M. Van Winkle; Thomas A. Schwyn

[57] ABSTRACT

A gas burner system including a burner body having a flange providing an annular surface. A removable cap is disposed above the burner body and contacts the annular surface for forming an annular interface with the burner body for closing the burner body. A plurality of ports are provided along the annular interface between the burner body and the cap. A first ignitor is disposed adjacent the annular interface between the burner body and cap. A second ignitor is also disposed adjacent the annular interface between the burned body and cap. Electronic means energize the first and second ignitors for generating sparks to ignite the gas burner. The energizing means include means for sensing the presence of flame at both the first and second ignitors such that during burner operation, if no flame is sensed at both the first and second ignitors, the ignitors are energized for generating sparks.

7 Claims, 4 Drawing Sheets

BURNER RE-IGNITION SYSTEM HAVING A PLURALITY OF FLAME SENSORS

BACKGROUND OF THE INVENTION

1. Field of the Invention

The present invention relates to a gas burner system and more particularly to a gas burner having a flame re-ignition system wherein a plurality of spark type ignitors are provided.

2. Description of the Related Art

Cooktop burners are typically ignited by the user opening a rotary valve in the fuel supply line to provide a flow of the fuel gas to the burner whereupon a set of switch contact are simultaneously closed for electrically energizing an ignitor having an electrode disposed to provide a spark in the stream of fuel/air mixture emanating from a port in the burner. When the spark gap of the electrode is bridged by flame, the resistance of the gap is effectively lowered, enabling current to flow across the gap. Accordingly, current flow across the spark gap, enabled by the presence of a flame creating a conduction path across the spark gap, may be electrically detected as an indication or proof of the presence of flame by a flame sensing circuit connected to the ignitor. This phenomena has been widely employed for combining the function of an ignitor with that of a flame sensor by providing flame sensing electrical circuitry which, upon the loss of flame, electrically detects the change of a current in the electrode and reenergizes the ignitor automatically.

One shortcoming of these prior art flame sensing systems is that if transient air currents extinguish the flame about only a portion of the annular periphery of the burner which includes the flame sensor, the fame sensor can not determine whether the flame has been totally extinguished and an annoying reenergization of the ignitor occurs. This is sometimes referred to as nuisance sparking wherein re-ignition sparking occurs even though a flame exists about a portion of the burner.

Prior efforts to avoid this nuisance sparking have focused on ways or means of preventing flame loss in the region of the flame sensing ignitor. U.S. Pat. No. 5,492,469 discloses a burner having a pocket formed in the periphery of the burner for receiving an ignitor. The pocket provides a protected region for maintaining flame about the ignitor.

SUMMARY OF THE INVENTION

A gas burner system including a burner body and a removable cap which is disposed above the burner body and contacts an annular surface for forming an annular interface with the burner body. A plurality of ports are provided along the annular interface between the burner body and the cap. A first ignitor is disposed adjacent the annular interface between the burner body and cap. A second ignitor is also disposed adjacent the annular interface between the burner body and cap. Electronic means energize the first and second ignitors for generating sparks to ignite the gas burner. The energizing means include means for sensing the presence of flame at both the first and second ignitors such that during burner operation, if no flame is sensed at both the first and second ignitors, the ignitors are energized for generating sparks.

DESCRIPTION OF THE PREFERRED EMBODIMENT

The burner construction that is set forth in the present application is similar to the burner described in U.S. Pat. No. 5,160,256 to Riehl, herein incorporated by reference.

Figure 1:
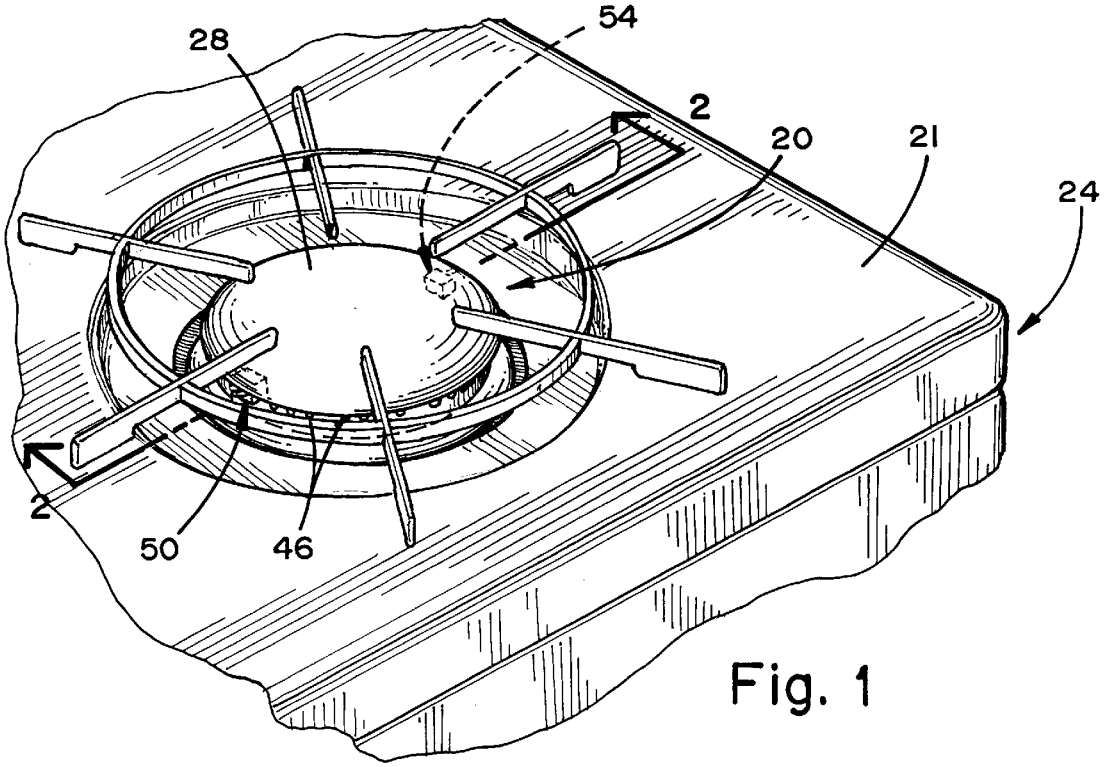
FIG. 1 is a fragmentary top perspective view illustrating the burner construction of the present invention mounted in a range top of a cooking apparatus.
Figure 2:
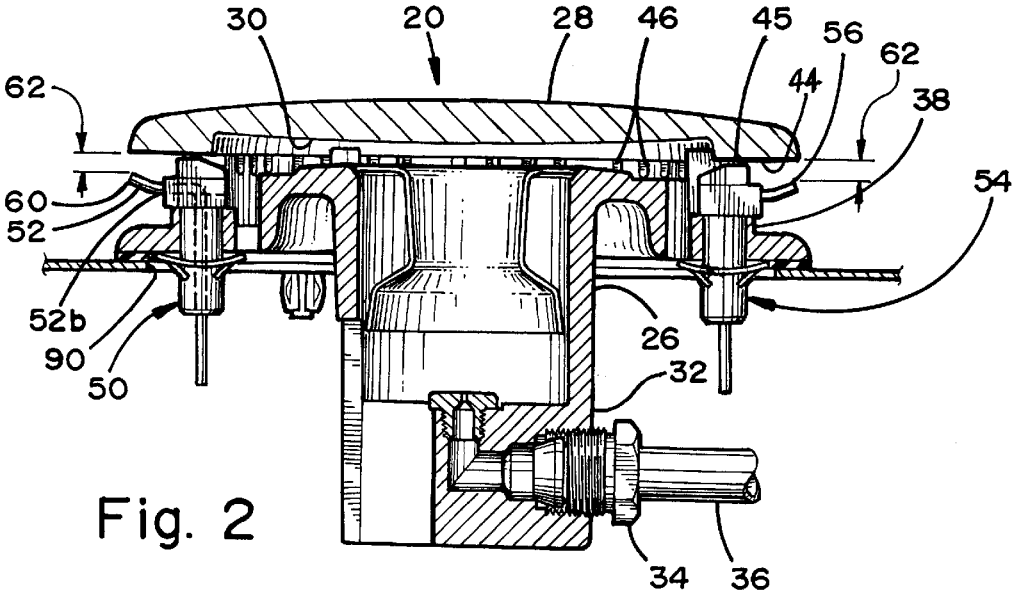
FIG. 2 is a enlarged fragmentary cross-sectional view taken along line 2—2 of FIG. 1.

Referring now to FIG. 1–2, the burner construction of the present invention is generally indicated by the reference numeral 20 and is illustrated as being sealed to the range top surface 22 of a cooking apparatus that is generally indicated by the reference numeral 24. The burner construction 20 comprises a burner body 26 and removable cap 28 defining a chamber 30. The burner body 26 includes a lower portion 32 having means 34 for interconnecting the chamber 30 with a fuel conduit 36.

Figure 3:
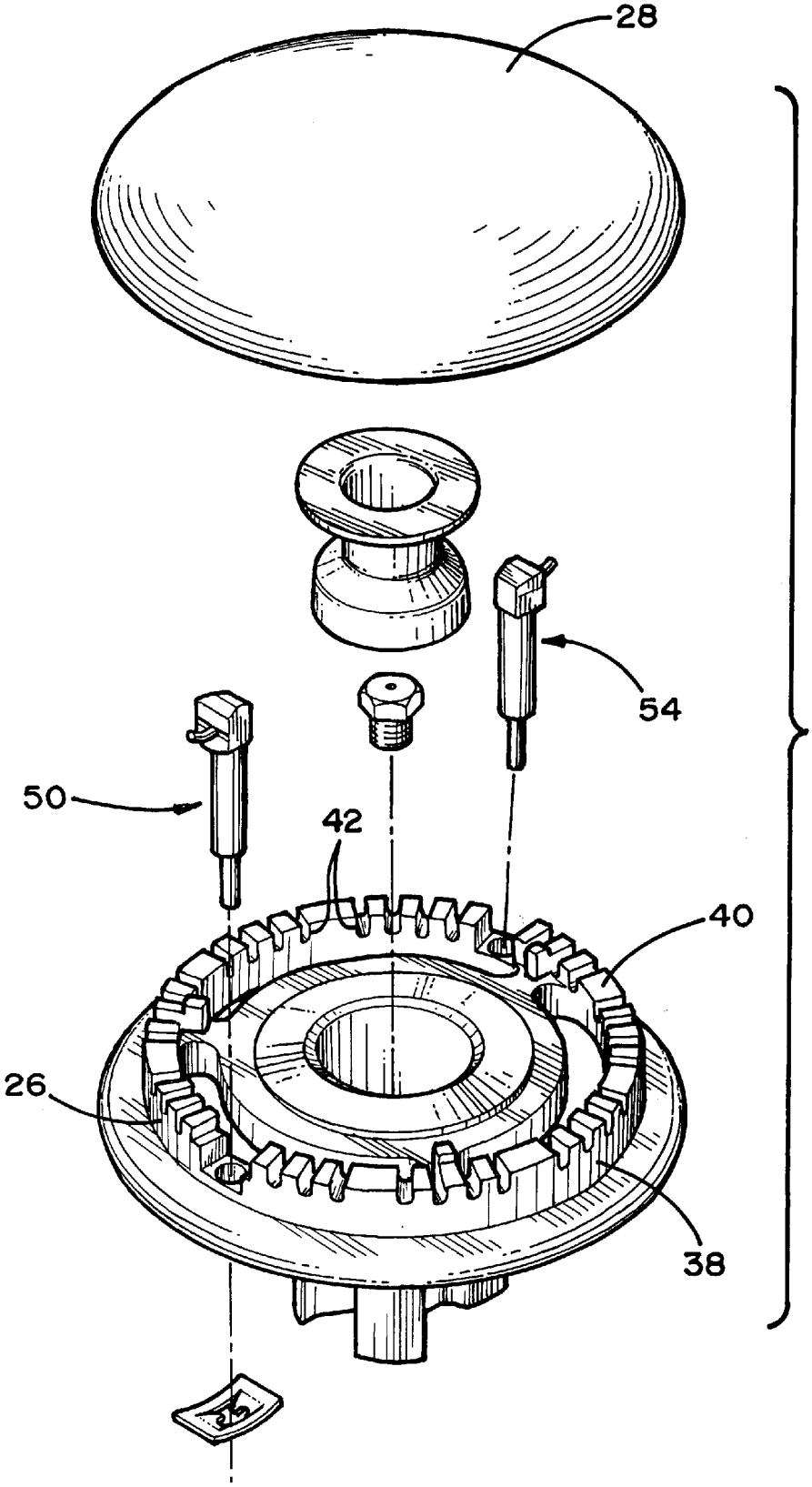
FIG. 3 is an exploded perspective view of the various parts of the burner construction of FIGS. 1–2.

The burner body 26 has an annular wall 38 provided with an annular substantially flat top surface 40 interrupted by a plurality of radially disposed and spaced apart U-shaped grooves 42 disposed in the circular array pattern as illustrated in FIG. 3. The cap 28 has a bottom surface forming a substantially flat annular surface 44 which forms an annular interface 45 with the annular flat top surface 40 when the cap is disposed in its closing position on the open end of the burner body in the manner illustrated in FIG. 2. Additionally, the grooves 42 in the body member 26 are adapted to be closed at the open ends by the substantially flat annular surface 44 for forming a plurality of ports 46 defined by the grooves 42 and flat annular surface 44 of the cap 28. As well known in the art, fuel can issue through the ports 46 and burn externally to the burner.

The burner 20 is provided with a first ignitor 50 having an electrode 52 and a second ignitor 54 having an electrode 56. Ignitors 50 and 54 are identical in configuration and are located along the outer periphery surface of the burner body 26 separated by a predetermined angular distance, preferably 180°. The electrodes 52 and 56 extend radially outward such that they are provided adjacent the annular interface 45 between the burner body 26 and the cap 28.

The electrodes 52 and 56 each comprise an L-shaped conductive member formed out of metallic material such as stainless steel wire or rod. Each electrode includes two legs disposed at substantially a 90° angle relative to each other and each have having an end portion 60 angled upwardly from a non-angled leg portion. An identical spark gap 62 is provided for both ignitors 50 and 54 between the electrodes 52 and 56 and the cap 28. For optimum operation, it is desirable that the spark gap 62 be the same dimension for both of the ignitors.

Figure 4:
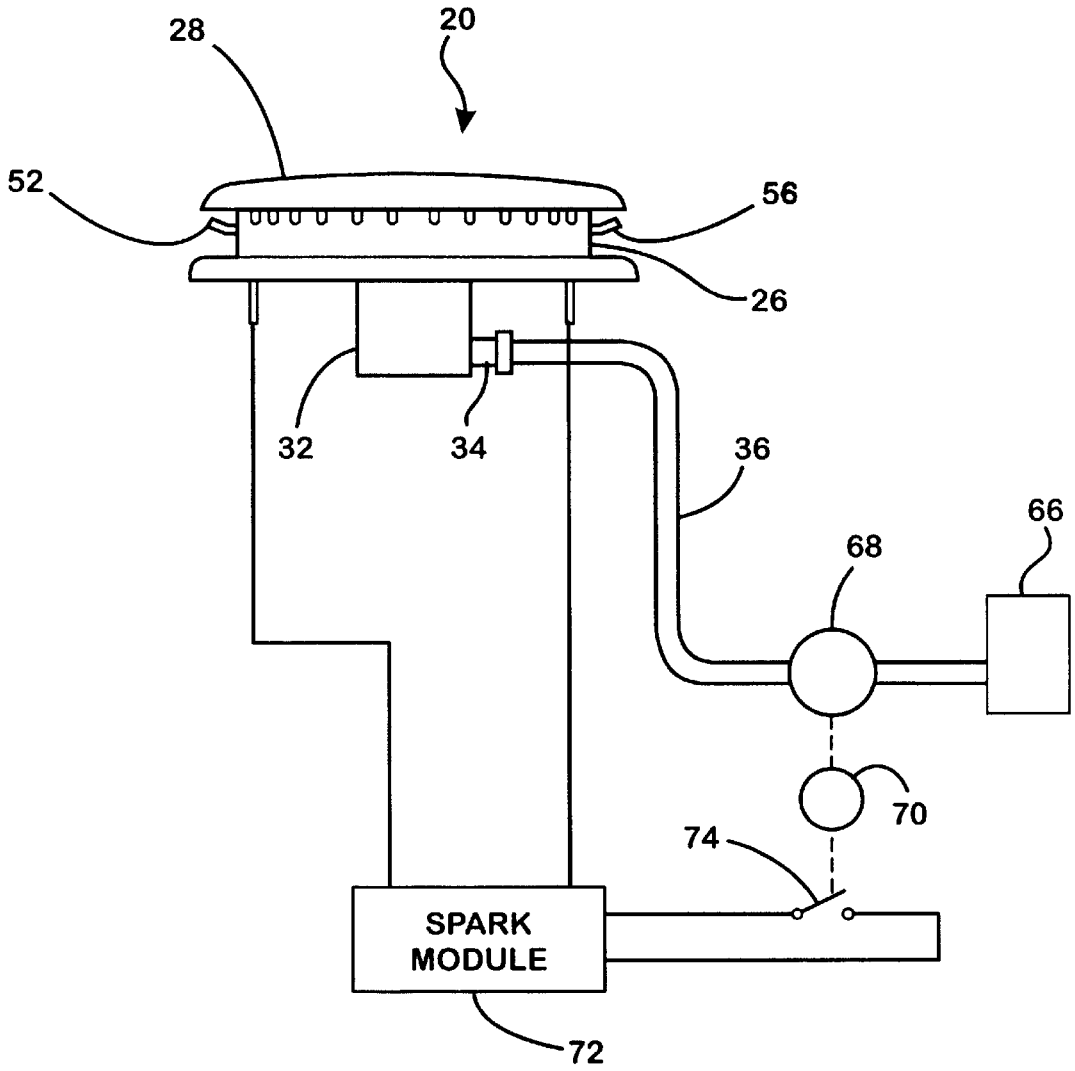
FIG. 4 is primarily a diagrammatic and schematic illustration of the burner assembly and the spark ignition system of the burner according to the present invention.
Figure 5:
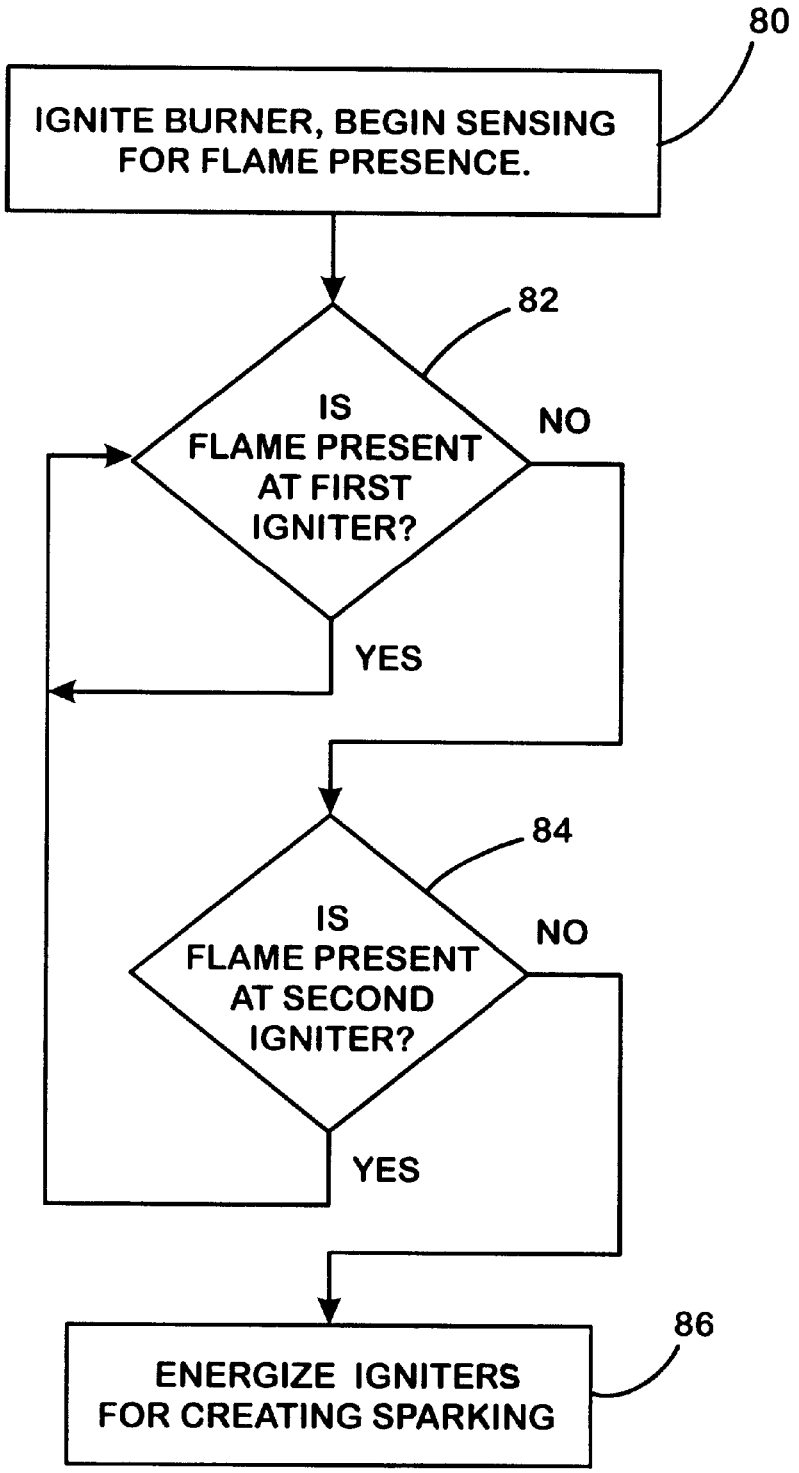
FIG. 5 is a flow chart illustrating the control logic in sensing the presence of flame on the burner of the present invention.

Turning to FIGS. 4 and 5, operation of the gas burner assembly can be understood. Gas is supplied to the burner 20 from a gas supply manifold 66 through a gas valve 68 and the conduit 36 terminating to the interconnection means 34 for connecting the conduit 36 to the burner 20. Burner flame size is selected by adjustment of the gas flow rate with a control knob 70, accessible along a surface of the range 24.

Gas flow through the valve 68 may be controlled by adjustment of the control knob 70 from an off or closed condition to a wide range of gas flow rates. A spark module ignition circuit 74 supplies power to the ignitors 50 and 54 for generating ignition sparks for the burner 20 in response to the closing of a switch 74 operatively associated with the burner valve 68 and control knob 70.

During ignition, when the valve 68 is opened, the switch 74 is closed, providing a signal to the spark module 72 for energizing the ignitors 50 and 54. Upon electrically energizing the ignitors 50 and 54, an electrical potential is created across the spark gaps 60 for causing sparking in the stream of fuel/air mixture emanating from the ports 46 in the burner. When the spark gap 60 of the electrodes 52 and 56 is bridged by flame, the resistance of the gap is effectively lowered enabling current to flow across the gap. Accordingly, the current flow across the spark gap 60 is sensed by the spark module 72 connected to the ignitors 50 and 54 and is electrically detected as an indication or proof of the presence of flame. U.S. Pat. No. 4,626,196, to Stohrer, illustrates one manner of using an ignitor as a flame sensor and is incorporated herein by reference.

The use of two ignitors in the burner 20 provides for a beneficial flame sensing capacity such that unnecessary nuisance sparking can be avoided. As shown in step 80, once the burner 20 is ignited, the presence of flame is sensed through the ignitors 50 and 54. In step 82, flame presence is sensed at the first ignitor 50. If no flame is detected, flame presence is sensed at the second ignitor 54, as shown in step 84. Only if the absence of flame is sensed at both the first and second ignitors are the ignitors re-energized for creating sparking, as shown in step 86.

In this manner, re-ignition of the burner 20 is only initiated if flame is absent from the area surrounding both of the ignitors. If transient air currents only extinguishes the flame about a partial annular portion of the burner 20, including the region around only one of the ignitors, sparking does not occur. Due to the plurality of ignitors, the flame sensing system of the present invention is able to effectively determine whether the flame has been totally extinguished. Only upon complete loss of flame and the resulting detection of the change in current flow across the electrodes does the spark module automatically reenergize the ignitors.

While the present invention has been described with reference the above described embodiments, those of skill in the Art will recognize that changes may be made thereto without departing from the scope of the invention as set forth in the appended claims.

We claim:

1. A gas burner system, comprising:

a burner body having a flange providing an annular surface;

a cap contacting the annular surface and forming an annular interface with the burner body for closing the burner body;

a plurality of ports provided along the annular interface between the burner body and the cap;

a first ignitor disposed adjacent the annular interface between the burner body and cap;

a second ignitor disposed adjacent the annular interface between the burner body and cap; and means for energizing the first and second ignitors for generating sparks to ignite the gas burner, energizing means including means for sensing the presence of flame at both the first and second ignitors such that during burner operation, if no flame is sensed at both the first and second ignitors, the ignitors are energized for generating sparks.

2. The gas burner system according to claim 1, further wherein:

the first ignitor has a first spark gap; and the second ignitor has a second spark gap, wherein the first and second spark gaps are controlled to be of equal distance.

3. The gas burner system according to claim 1, further wherein the first and second ignitors are located along the annular interface a predetermined angular distance from each other.

4. The gas burner system according to claim 3, further wherein the first and second ignitors are located along the annular interface 180° from each other.

5. A method of re-igniting a gas burner when the burner flame is blown out, the gas burner having a plurality of fuel ports provided through an annular wall for supporting an annular flame about the burner, the method comprising the steps of:

sensing the presence of flame at a first predetermined position along the annular wall;

sensing the presence of flame at a second predetermined position along the annular wall if no flame is sensed at the first predetermined position; and generating sparks for re-igniting the burner if no flame is sensed at both the first and second predetermined position.

6. The method for re-igniting a gas burner according to claim 5, wherein the first and second predetermined positions for sensing flame are located along the annular wall of the burner 180° from each other.

7. The method for re-igniting a gas burner according to claim 5, further wherein a first ignitor and a second ignitor are used for sensing the presence of flame along the annular wall of the burner.

* * * * *